United States Patent [19]

Biesemeyer

[11] Patent Number: 4,649,000

[45] Date of Patent: Mar. 10, 1987

[54] EVAPORATIVE COOLER

[76] Inventor: William M. Biesemeyer, 1703 N. Doran, Mesa, Ariz. 85203

[21] Appl. No.: 806,403

[22] Filed: Dec. 9, 1985

[51] Int. Cl.[4] ..... B01F 3/04

[52] U.S. Cl. ..... 261/92; 62/304; 261/DIG. 3; 261/DIG. 41

[58] Field of Search ..... 261/92, DIG. 3, DIG. 15, 261/DIG. 41, DIG. 4; 55/231, 232; 210/402; 126/113; 62/304, 314

[56] References Cited

U.S. PATENT DOCUMENTS

| | | | |
|---|---|---|---|
| 2,289,825 | 7/1942 | Burton et al. | 261/92 X |
| 2,300,580 | 11/1942 | Loprich | 261/92 X |
| 2,584,618 | 2/1952 | Robic | 261/92 |
| 3,251,402 | 5/1966 | Glav | 261/92 X |
| 3,352,297 | 11/1967 | Martin et al. | 261/92 X |
| 3,596,886 | 8/1971 | Trautman | 261/92 |
| 3,610,589 | 10/1971 | Paulin | 261/92 X |
| 3,913,890 | 10/1975 | Lankenau et al. | 261/92 X |
| 4,160,736 | 7/1979 | Prosser | 261/92 X |

*Primary Examiner*—Richard L. Chiesa
*Attorney, Agent, or Firm*—Cahill, Sutton & Thomas

[57] ABSTRACT

An evaporative cooler is disclosed incorporating a horizontally disposed hollow cylindrical pad mounted for rotation above a water tray. The cylindrical pad extends into water placed in the tray and is rotated to continuously immerse a portion of the pad. The pad is supported through a plurality of rollers contacting circumferential bands positioned thereon; the rollers providing all of the support and all of the rotational force to the cylindrical pad.

3 Claims, 11 Drawing Figures

FIG. 2
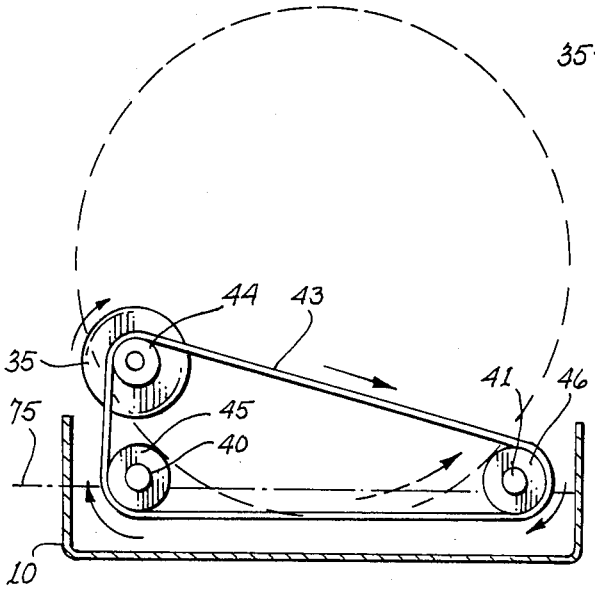
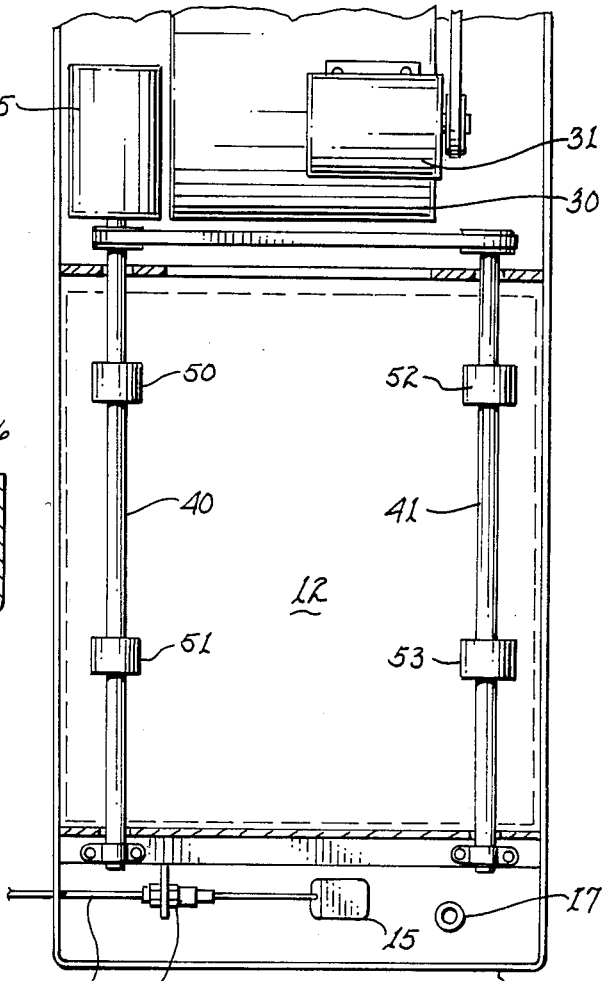
FIG. 3
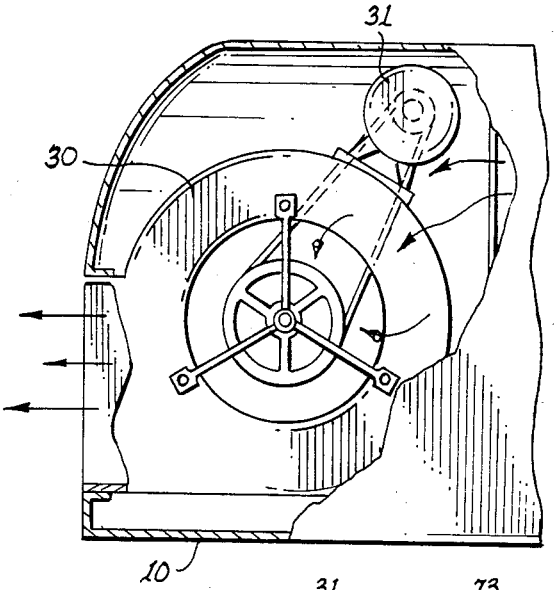
FIG. 5
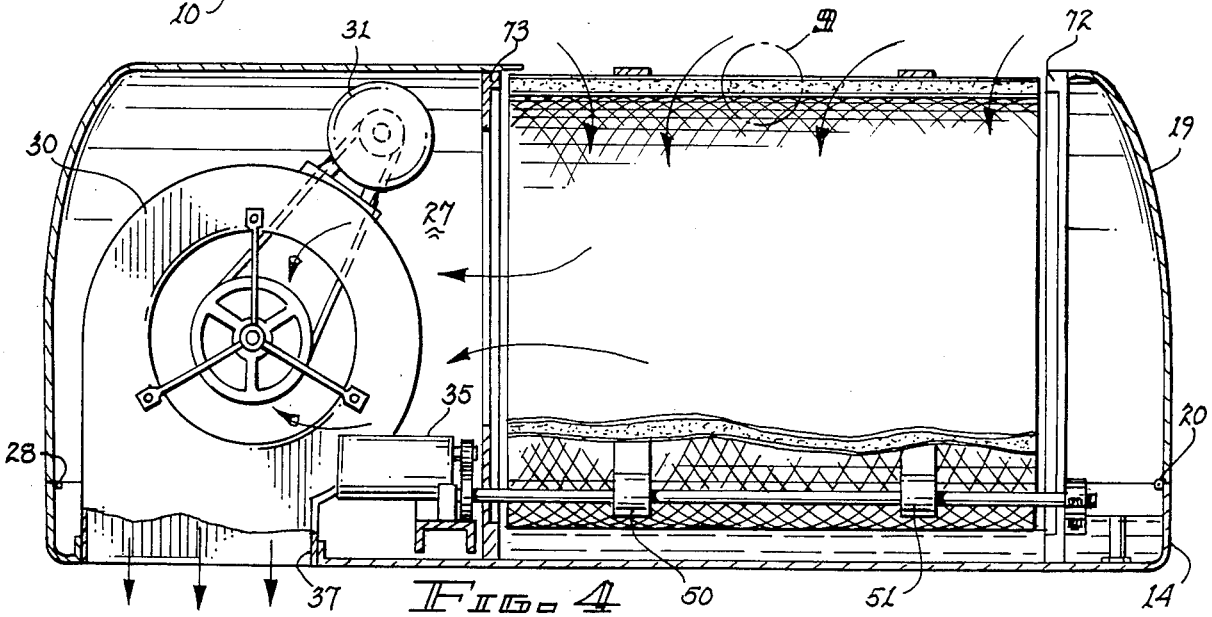
FIG. 4

EVAPORATIVE COOLER

FIELD OF THE INVENTION

The present invention pertains to air cooling systems and more particularly to evaporative coolers incorporating cooler pads having a portion thereof immersed in water for evaporation.

BACKGROUND OF THE INVENTION

The utilization of evaporative cooling for reducing air temperature is an old and well known art. Typically, cooler pads of various configurations are either partially immersed in water or have water sprayed thereon while relatively warm and low moisture air is passed through the pad causing evaporation and thus effectively reducing the temperature of the air as it exits the pad. As indicated above, the pads may take a variety of configurations and in some instances may be mounted for movement so that a portion of the pad is continuously immersed in water. For example, the use of a cylindrical drum shape for a cooler pad is known in the prior art; a portion of the pad may be immersed in water or water may be directed in some other manner onto the pad. The air to be evaporatively cooled is drawn through the pad from the inside or outside of the cylinder. While such configurations provide numerous advantages, they nevertheless are inherently difficult to maintain.

One of the chief drawbacks of an evaporative system is the necessity for frequently servicing the cooler pads. When the pads are formed into a cylinder and mounted for rotation as described above, the removal of the pads becomes very cumbersome. The difficulty encountered during the frequent servicing of the cooler pads renders the cylindrical configuration particularly inconvenient.

OBJECTS OF THE INVENTION

It is therefore an object of the present invention to provide an evaporative air cooling system incorporating a cylindrical evaporator pad.

It is another object of the present invention to provide an evaporative air cooling system incorporating a cylindrical evaporator pad that is conveniently removed for servicing.

It is still another object of the present invention to provide an evaporative cooling system incorporating a cylindrical cooling pad that is simple in design and presents a minimum of structural features interfering with the air flow and permits very simple removal of the evaporative pad for servicing.

These and other objects of the present invention will become apparent to those skilled in the art as the description thereof proceeds.

SUMMARY OF THE INVENTION

A cylindrical evaporative pad is formed having bands positioned about the periphery thereof. The bands may be used to maintain the pad in its cylindrical form and are used as the sole support contact area for the pad. The pad is positioned over a water tray such that the lower portion of the pad is immersed in the water; the cylinder is supported on a plurality of rollers positioned on either side of the cylinder contacting the circumferential bands. The rollers are mounted on parallel shafts positioned below and on either side of the cylindrical pad and are driven through a belt drive from an electric motor. A centrifugal fan and fan motor are mounted within a housing axially displaced from the cylindrical pad to create a negative pressure within the cylinder and draw ambient air through the evaporative pad into the centrifugal blower and out of the housing through an output duct.

The cooler pad may be removed for servicing by merely lifting the cylindrical pad out of contact with its supporting rollers and without disassembly of any part of the evaporative cooling system.

BRIEF DESCRIPTION OF THE DRAWINGS

The present invention may more readily be described by reference to the accompanying drawings in which:

FIG. 2 is an end view of a portion of the system of FIG. 1 showing the roller drive motor and belt.

FIG. 3 is a partial top view of the system of FIG. 1 with the cylindrical evaporative pad removed.

FIG. 4 is a side elevational view, partly in section, of the system of FIG. 1.

FIG. 5 is a side view of a portion of the system of the present invention partly broken away showing an alternative air flow direction for evaporatively cooled air.

DETAILED DESCRIPTION OF THE PREFERRED EMBODIMENT

Figure 1:
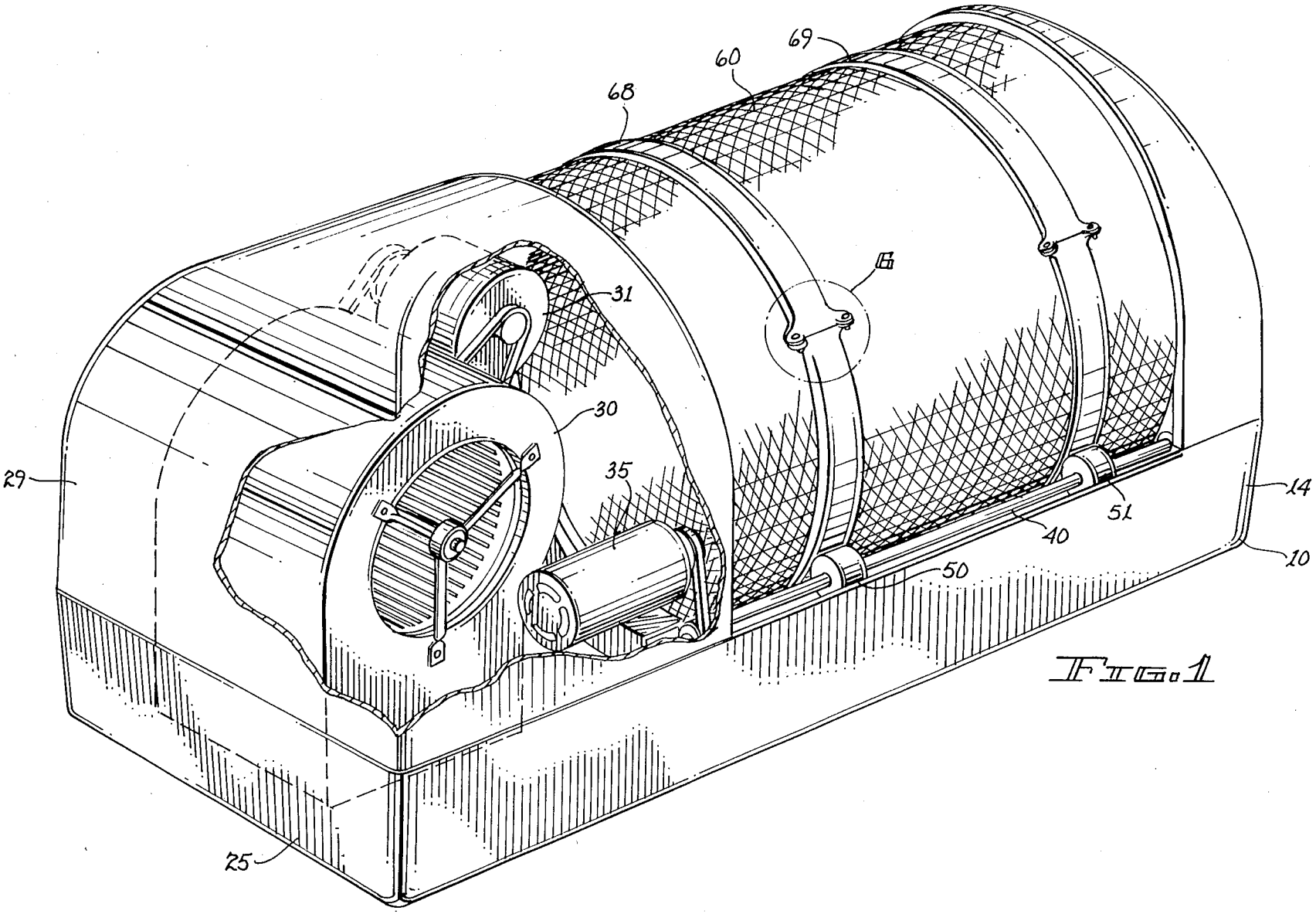
FIG. 1 is a perspective view, partly broken away, of an evaporative cooling system incorporating the teachings of the present invention.

Referring now to the drawings, the present invention incorporates a base member 10 having a portion therein 12 forming a tray for containing water. At one end 14 of the base member water level apparatus is positioned. That is, a conventional float 15 is connected to a valve 16 which in turn is connected to a suitable supply of water through the pipe 17. The float assures the maintenance of a predetermined level of water in the tray 12. An overflow pipe 17 is also provided; all of the water level apparatus may be positioned at one end of the base 10 out of the path of the evaporative pad and the flow of air. The end 14 of the base member 10 is provided with a hinged cover 19 that may be pivoted about the hinge 20 to expose the water level apparatus for adjustment or service.

The other end 25 of the base member forms part of a motor housing 27 that includes a centrifugal blower 30 with its blower motor 31 mounted thereon, and an evaporative cooling pad drive motor 35. The centrifugal blower may be arranged to direct air downwardly through exit duct 37 as shown in FIG. 4 or may be arranged to direct air outwardly through a side draft arrangement as shown in FIG. 5.

The cooler pad motor 35 is arranged to drive a pair of roller shafts 40 and 41 through the use of a belt 43 passing over the motor pulley 44 and over pulleys 45 and 46. The roller shafts 40 and 41 may be journaled for rotation about their respective axis in any conventional manner but are arranged in a horizontal plane and parallel to each other. The roller shafts support a plurality of rollers 50–53 mounted thereon and secured for rotation therewith.

Figure 6:
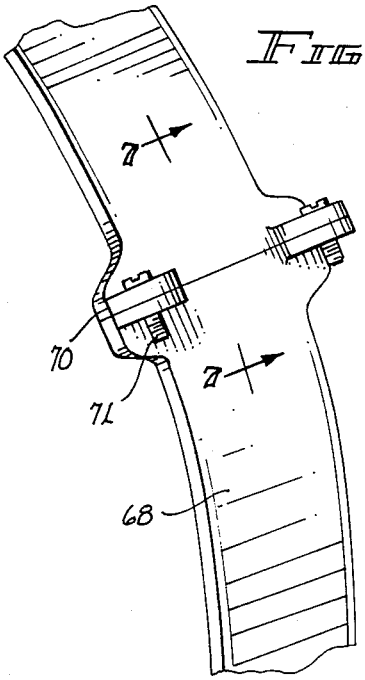
FIG. 6 is a perspective view of one of the cylindrical bands used on the cylindrical drum of the present invention.
Figure 7:
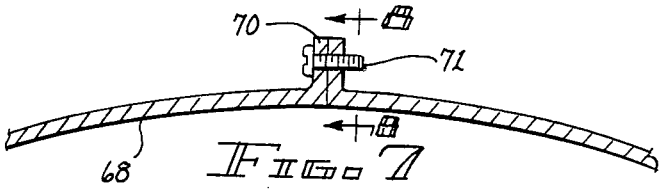
FIG. 7 is a cross-sectional view of FIG. 6 taken along lines 7—7.
Figure 8:
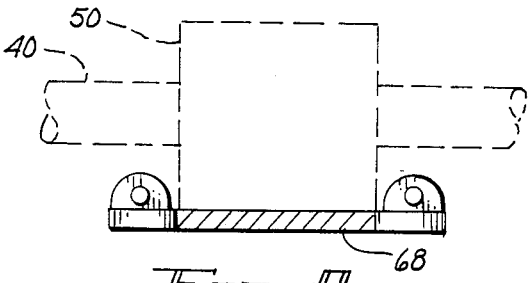
FIG. 8 is a cross-sectional view of FIG. 7 taken along line 8—8 with the addition of phantom lines indicating the positioning of a roller.
Figure 9:
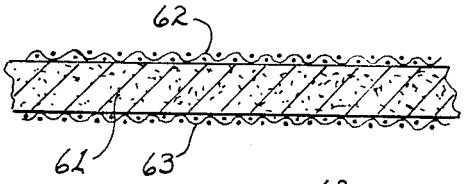
FIG. 9 is a cross-sectional view of a portion of a cooler pad of the type used in the cylindrical pad of the present invention.
Figure 10:
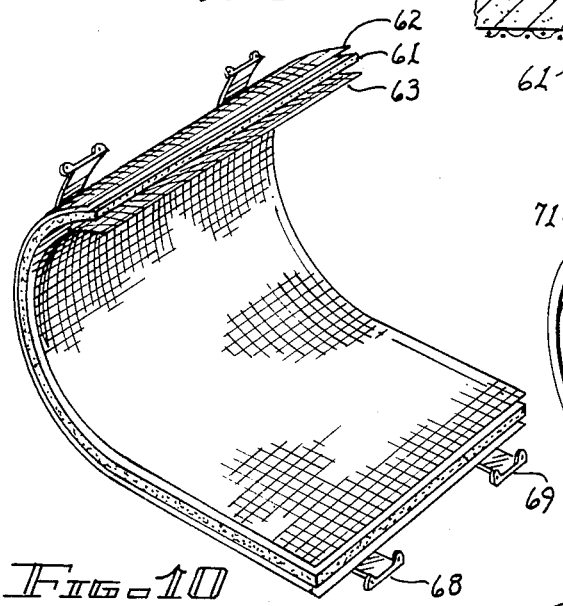
FIG. 10 is an illustration of a cooler pad partially formed into a cylinder showing the manner in which the cylindrical pad may be constructed.

A cooler or evaporative pad formed into a cylinder 60 may be formed with conventional evaporative cooling pad material 61 sandwiched between wire mesh 62 and 63. The specific construction of the cylindrically formed evaporative pad is not critical; however, the thickness of the pad, the composition of the pad, as well as the strength and size of the mesh should be chosen to provide the desired characteristics of an evaporative pad as well as strength to assist in maintaining its cylindrical shape. The pad may be formed in a manner suggested by FIG. 10 wherein it may be seen that the mesh 62 and 63 positioned on either side of the evaporative pad 61 is rolled into a cylindrical shape and maintained in that shape by circumferentially extending bands 68 and 69. The bands may be formed of any non-corroding material such as stainless steel and may be joined at their respective ends in a manner such as that shown in FIGS. 6 and 7 by incorporating flanges 70 to accept a bolt or machine screw 71.

Figure 11:
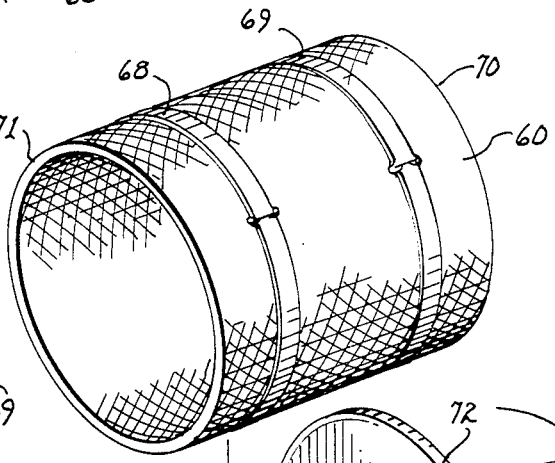
FIG. 11 is a perspective view of an evaporative cooling system constructed in accordance with the teachings of the present invention showing the cylindrical cooling pad removed from the system.
Figure 11:
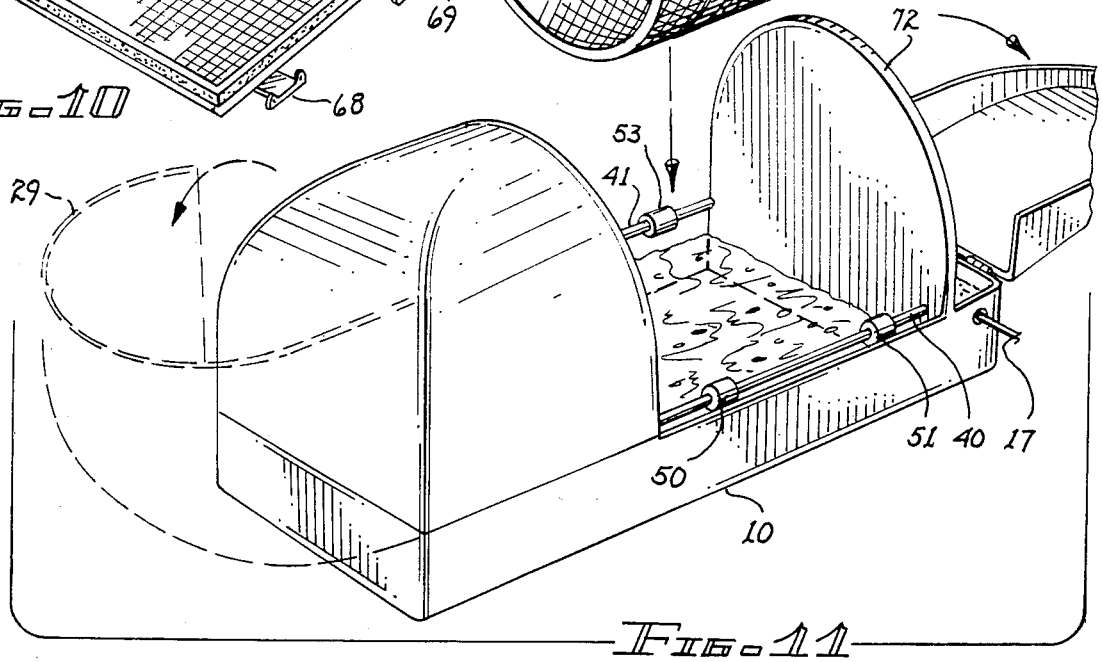

The bands 68 and 69 serve a dual function; they of course assist in maintaining the evaporative pad in a cylindrical form, and their most important function is providing a supporting and drive surface for contacting the rollers 50–53. The cylindrically shaped evaporative pad 60 is thus lowered, as shown in FIG. 11, into the evaporative cooling system of the present invention such that the bands 68 and 69 contact the rollers 50, 51, 52 and 53 to thereby support the evaporative pad. It may be noted that the sole supporting means for the cylindrical pad 60 are the rollers 50–53, and the only force being exerted on the rollers by the cylindrical pad is simply the weight of the pad and any water it may absorb. The pad is thus positioned for free vertical movement into or out of the system to permit removal of the cylindrical pad without the removal of any drive mechanism or supporting mechanism, and without the removal of or repositioning of any other apparatus such as air flow fans, blowers, water conduits or pipes.

The axial length of the cylinder 60 may be chosen such that it rides on the rollers 50–53 with the ends 70 and 71 of the roller in close proximity to or perhaps even in light rubbing contact with end plates 72 and 73 respectively attached to base 10 to thereby minimize the airflow from the outside of the system around the cylinder instead of through the cylinder.

In operation, the evaporative cooling pad formed into the cylindrical shape as shown is lowered into the system such that the bands 68 and 69 ride on their respective drive rollers. The lower portion of the cylinder is thus immersed in water (water level is shown in FIG. 2 at 75) to thereby saturate that portion of the cooler pad. The cooler pad motor 35 rotates the shafts 40 and 41 to thereby rotate the cylindrical pad about its horizontal axis to continuously introduce the cooling pad into the water. The shafts 40 and 41, extending horizontally and parallel to each other thus provide the only drive to the cylindrical pad through the rollers 50–53 in contact with the respective circumferential bands 68 and 69. The rate of rotation of the cylindrical pad may obviously be varied to correspond to the rate of evaporation.

With the cylindrical pad in position and being rotated to introduce water into the pad, the blower 30 draws air into the system through the periphery of the cylindrical pad thus causing evaporation and cooling of the air as it passes through the pad into the interior of the cylinder. The cooled air thus passes through the blower and out the exit duct. The blower speed may of course be variable to provide the desired air flow and evaporative cooling effect. The water flow thus need never be adjusted to correspond to any particular rate of evaporation since the water pan is automatically retained at a particular water level and the rate of evaporation has no effect on that level. The water tray may be formed of fiberglass or other noncorrosive material while the mesh retaining the cooling pad may be formed of a noncorrosive material and the rollers may be formed of a plastic. Servicing the cooling pad of the present invention thus becomes extremely simple since all that needs to be done to remove the pad is simply lift it out of contact with the supporting end drive rollers without the removal of any mechanism.

For convenience, the motor housing 27 may be secured through a hinge 28 attached to the base member 10 to thus permit the housing to be pivoted out of the way as indicated at 29 in FIG. 11 to expose the blower 30, its corresponding blower motor 31, and the cooler pad motor 35. The embodiment chosen for illustration incorporates two circumferential support and drive bands 68 and 69; however, it may be convenient in certain circumstances to incorporate a larger number of bands, particularly in applications where the system may be used on commercial establishments and the size of the cylindrical pad requires additional support.

I claim:

1. An evaporative cooling system comprising:

(a) a tray for holding water;

(b) a hollow cylindrical evaporative pad having two ends mounted for rotation about a horizontal axis above said tray with a lower portion of said pad immersed in said water;

(c) a pair of rotating support shafts mounted for rotation about an axis parallel to the rotational axis of said cylindrical pad, each of said shafts including a roller mounted thereon for contacting, supporting, and imparting rotational movement to said cylindrical pad;

(d) said cylindrical pad including a circumferential band mounted thereon and spaced from said ends;

(e) said cylindrical pad, mounted, supported, and rotated through contact between said circumferential band and said rollers, and positioned for free vertical movement into and out of contact with said rollers to permit removal of said cylindrical pad from said system without disassembly of any part of said system.

2. An evaporative cooling system comprising:

(a) a tray for holding water;

(b) a hollow cylindrical evaporative pad having two ends mounted for rotation about a horizontal axis above said tray with a lower portion of said pad immersed in said water;

(c) a pair of rotating support shafts mounted for rotation about an axis parallel to the rotational axis of said cylindrical pad, each of said shafts including a plurality of support rollers mounted thereon for contacting, supporting and imparting rotational movement to said cylindrical pad;

(d) said cylindrical pad including a plurality of circumferential bands mounted thereon and spaced from said ends corresponding in number to the number of rollers on each of said support shafts;

(e) said cylindrical pad mounted, supported, and rotated through contact between said circumferential bands and rollers, and positioned for free vertical movement into and out of contact with said rollers to permit removal of said cylindrical pad from said system without disassembly of any part of said system.

3. The evaporative cooling system as set forth in claim 1 or 2 wherein said circumferential band is clamped around said hollow cylindrical evaporative pad to hold the pad in its cylindrical shape while forming a contacting surface to contact said rollers.

* * * * *